US011085246B2

(12) United States Patent
Hudson et al.

(10) Patent No.: US 11,085,246 B2
(45) Date of Patent: Aug. 10, 2021

(54) ASSIST CYLINDER FOR NEGATIVE ANGLE DRILLING MAST

(71) Applicant: Caterpillar Global Mining Equipment LLC, Denison, TX (US)

(72) Inventors: Charles Taylor Hudson, Sherman, TX (US); Richard J. LaReau, Decatur, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 328 days.

(21) Appl. No.: 16/107,805

(22) Filed: Aug. 21, 2018

(65) Prior Publication Data

US 2020/0063502 A1 Feb. 27, 2020

(51) Int. Cl.
*E21B 15/04* (2006.01)
*E04H 12/18* (2006.01)
*E04H 12/34* (2006.01)

(52) U.S. Cl.
CPC ..... *E21B 15/045* (2013.01); *E04H 12/187* (2013.01); *E04H 12/345* (2013.01)

(58) Field of Classification Search
CPC ..... E21B 15/04; E21B 15/045; E04H 12/345
See application file for complete search history.

(56) References Cited

U.S. PATENT DOCUMENTS 8,671,626 B1 3/2014 Marty et al.
8,782,968 B2 * 7/2014 Benson ..... E21B 15/04 52/116
9,719,271 B2 8/2017 Trevithick et al.
2017/0191319 A1 7/2017 Gonzalez et al.

FOREIGN PATENT DOCUMENTS

DE 4436264 C1 * 11/1995 ..... E21B 7/023
EP 1983147 A2 * 10/2008 ..... E21B 7/02

* cited by examiner

*Primary Examiner* — Giovanna Wright

(57) ABSTRACT

A mobile drilling machine may include a drilling mast having a mast frame, a movable drill motor assembly, and a pivot; a machine frame including front and back portions, an engine, a ground engaging assembly, and a coupling assembly including first and second side plates, where the mast is pivotably coupled at the pivot between the first and second side plates; at least one primary fluid cylinder coupled to the machine frame to apply a force to the mast at a position above the pivot along the mast to assist in moving the mast between a stowed position to a drilling position; and a secondary fluid cylinder coupled to the machine frame to apply a force to the mast at a position below the pivot along the mast to assist the at least one primary fluid cylinder when the mast is at a negative drilling angle.

17 Claims, 4 Drawing Sheets

ASSIST CYLINDER FOR NEGATIVE ANGLE DRILLING MAST

TECHNICAL FIELD

The present disclosure relates generally to mobile drilling machines, and more particularly, to an assist cylinder for a negative angle drilling mast.

BACKGROUND

Mobile drilling machines, such as blast hole drilling machines, are typically used for drilling blast holes for mining, quarrying, dam construction, and road construction, among other uses. The process of excavating rock, or other material, by blast hole drilling comprises using the blast hole drill machine to drill a plurality of holes into the rock and filling the holes with explosives. The explosives are detonated causing the rock to collapse, and rubble of the collapse is then removed and the new surface that is formed is reinforced. Many current blast hole drilling machines utilize rotary drill rigs, mounted on a mast, that can drill blast holes anywhere from 6 inches to 22 inches in diameter and depths up to 150 feet. Hydraulic cylinders are typically used to raise the mast from a lowered, horizontal position to a raised, vertical position. Such hydraulic cylinders may support the mast at angles between the horizontal position and the vertical position. However, current blast hole drilling machines may not allow for the mast to pivot beyond the vertical position for blast holes to be drilled at negative angles with respect to the vertical position. This may be due to the substantial forces associated with moving the mast beyond the vertical position.

U.S. Pat. No. 8,671,626, issued to Marty et al. on Mar. 18, 2014 ("the '626 patent"), describes a drilling rig assembly comprising a drilling rig skid and a derrick assembly adapted to move relative to the drilling rig skid. The means for moving the derrick assembly of the '626 patent relative to the drilling rig skid includes a derrick assembly hydraulic cylinder. The hydraulic cylinder is adapted to move the derrick assembly so that the drilling rig assembly may be operated at positive angles between 0 degrees and 55 degrees from the vertical position. However, the hydraulic cylinder of the '626 patent is not disclosed as capable of pivoting the derrick assembly beyond the vertical position for negative angle drilling. The mobile drilling machine of the present disclosure may solve one or more of the problems set forth above and/or other problems in the art. The scope of the current disclosure, however, is defined by the attached claims, and not by the ability to solve any specific problem.

SUMMARY

In one aspect, a mobile drilling machine for negative angle drilling may comprise: a drilling mast including a mast frame, a movable drill motor assembly, and a pivot; a machine frame having a front portion and a back portion, the machine frame including: an engine; a ground engaging assembly; a mast coupling assembly including: a first side plate; and a second side plate, wherein the drilling mast is pivotably coupled at the pivot between the first side plate and the second side plate to allow for negative angle drilling; at least one primary fluid cylinder coupled to the machine frame to apply a force to the drilling mast at a position above the pivot along the drilling mast to assist in moving the drilling mast between a stowed position to a drilling position; and a secondary fluid cylinder coupled to the machine frame to apply a force to the drilling mast at a position below the pivot along the drilling mast to assist the at least one primary fluid cylinder when the drilling mast is at a negative drilling angle.

In another aspect, a mobile drilling machine for negative angle drilling may comprise: a drilling mast including a mast frame, a movable drill motor assembly, and a pivot; a machine frame having a front portion and a back portion, the machine frame including: an engine; a ground engaging assembly; a mast coupling assembly including: a first side plate; and a second side plate, wherein the drilling mast is pivotably coupled at the pivot between the first side plate and the second side plate to allow for negative angle drilling; a support plate located behind the pivot; at least one primary fluid cylinder coupled to the machine frame to apply a force to the drilling mast at a position above the pivot along the drilling mast to assist in moving the drilling mast between a stowed position to a drilling position; and a secondary fluid cylinder coupled at a first end to the support plate and coupled at a second end to a positioning member to vertically position the second end of the secondary fluid cylinder, the secondary fluid cylinder being configured to apply a force to the drilling mast at a position below the pivot along the drilling mast to assist the at least one primary fluid cylinder only when the drilling mast is at a negative drilling angle.

In yet another aspect, a method of operating a mobile drilling machine to move a drilling mast about a pivot for negative angle drilling may comprise: activating at least one primary fluid cylinder coupled to the drilling mast above the pivot along the drilling mast to move the drilling mast about the pivot from a positive drilling angle position to a negative drilling angle position; and engaging a secondary fluid cylinder with the drilling mast below the pivot along the drilling mast to assist the at least one primary fluid cylinder when the drilling mast is in the negative drilling angle position.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
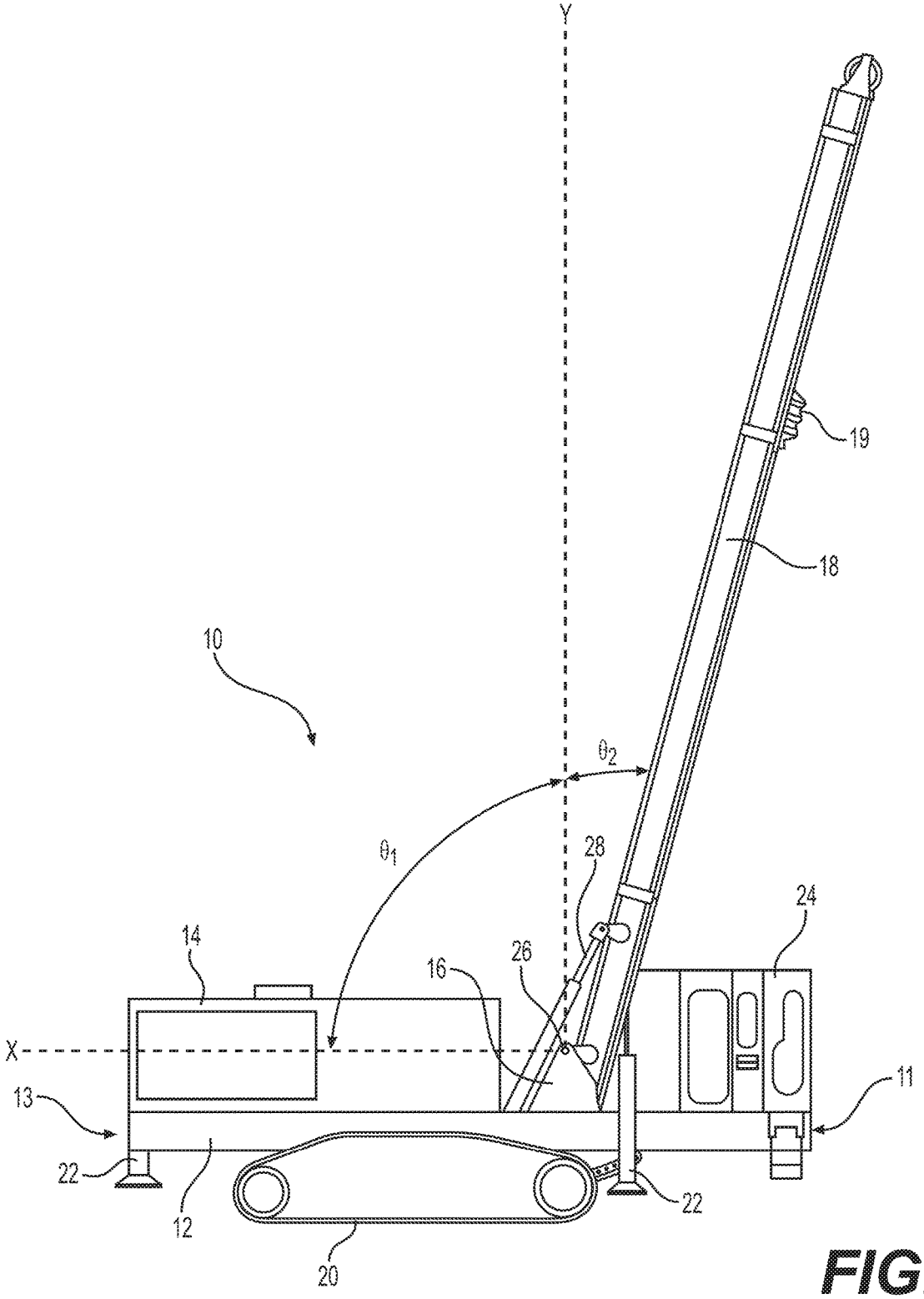
FIG. 1 illustrates a side view of an exemplary mobile drilling machine according to aspects of this disclosure.

FIG. 1 illustrates a side view of an exemplary mobile drilling machine 10, such as a blast hole drilling machine. Mobile drilling machine 10 may be capable of negative angle drilling, as further discussed below. As shown in FIG. 1, mobile drilling machine 10 may include a machine frame 12 having a front portion 11 and a back portion 13, a machinery housing 14, a mast coupling assembly 16, and a drilling mast 18. Machine frame 12 may be supported on a ground surface by a ground engaging assembly 20, such as crawler tracks or the like. Ground engaging assembly 20 may allow mobile drilling machine 10 to maneuver about the ground surface to a desired location for drilling. Machine frame 12 may further include a plurality of jacks 22. During a drilling operation, the jacks 22 may be lowered to secure, support and level mobile drilling machine 10 on the ground surface. Machine frame 12 may support the machinery housing 14, which may house motors, an engine, air compressors, and any other equipment necessary to power and operate mobile drilling machine 10. Machine frame 12 may further support an operator cab 24, from which an operator may maneuver and control mobile drilling machine 10.

As further shown in FIG. 1, mobile drilling machine 10 may include a mast coupling assembly 16 for mounting a drilling mast 18 onto the mobile drilling machine 10. Drilling mast 18 may include a mast frame which may support a movable drill motor assembly 19. Drilling mast 18 may be any suitable mast capable of being mounted within mast coupling assembly 16. Mast coupling assembly 16 may be mounted within machine frame 12 and may support the drilling mast 18 at a pivot 26. Drilling mast 18 may further be supported by at least one primary fluid cylinder 28 attached to the drilling mast 18 at a position above pivot 26. The at least one primary fluid cylinder 28 may be any suitable actuator, such as a hydraulic or pneumatic cylinder or the like. The at least one primary fluid cylinder 28 may be configured to apply a force to the drilling mast 18 to rotate the drilling mast 18 about pivot 26. Thus, the at least one primary fluid cylinder 28 may assist in moving the drilling mast 18 between a stowed position, at ninety degrees (90°) from the vertical position Y, to a positive drilling angle position $\theta_1$ up to zero degrees (0°) from the vertical position Y. As described below, the mobile drilling machine 10 of the disclosure may further allow for the drilling mast 18 to be set to drilling angles beyond the vertical position Y to a negative drilling angle position $\theta_2$.

Figure 2:
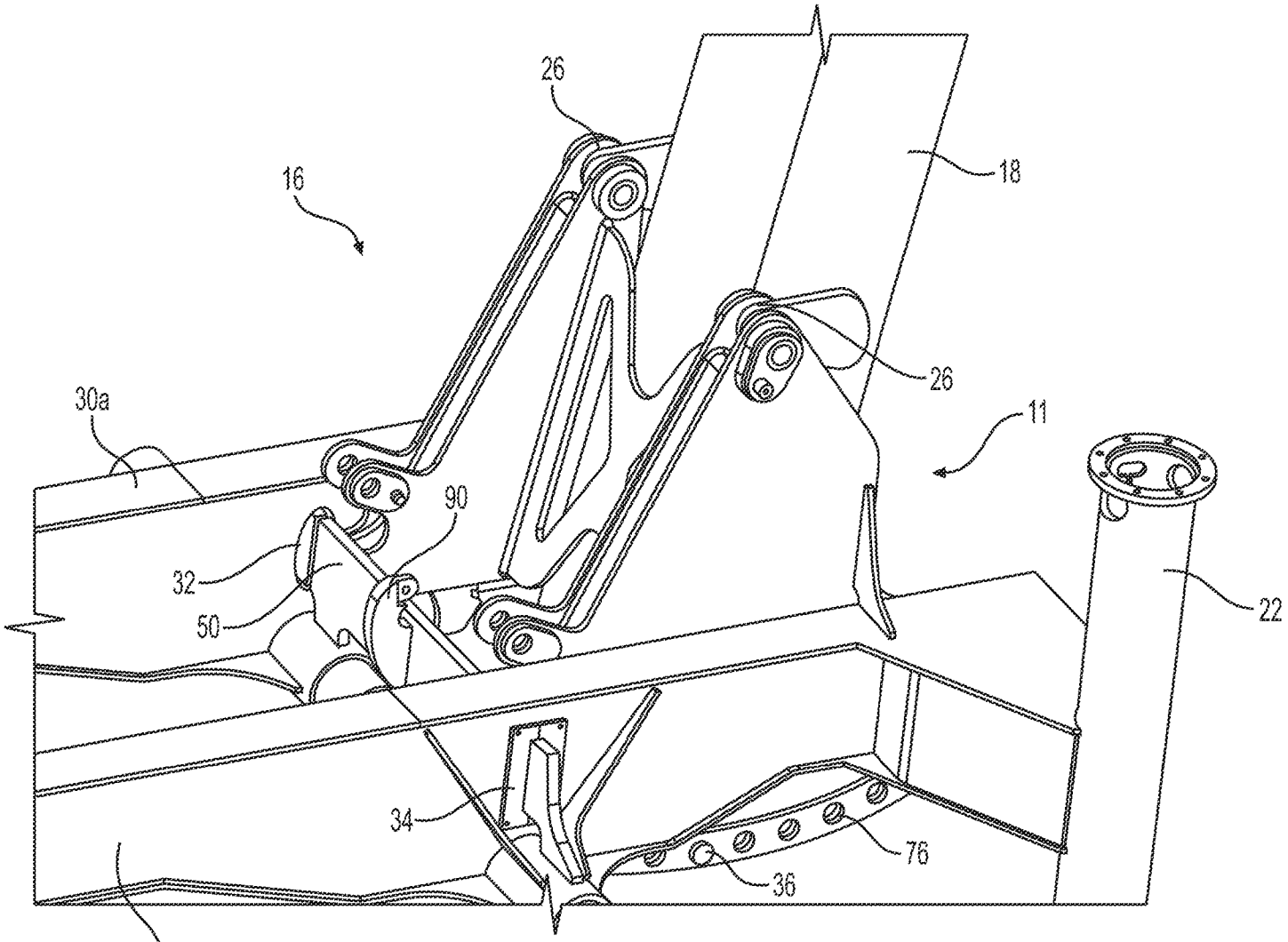
FIG. 2 illustrates a perspective view of an exemplary mast coupling assembly of the mobile drilling machine of FIG. 1.

FIG. 2 illustrates a perspective view of an exemplary mast coupling assembly 16 mounted in the machine frame 12 of the mobile drilling machine 10. Machine frame 12 may comprise one or more beams 30. For example, machine frame 12 may include at least a first beam 30*a* and a second beam 30*b*. However, machine frame 12 may include any number of beams 30, as necessary. Mast coupling assembly 16 may be arranged between the first beam 30*a* and the second beam 30*b*. Mast coupling assembly 16 may be attached to the first beam 30*a* and the second beam 30*b* by any conventional manner known in the art, such as by welding or the like. Machine frame 12 may further include a support plate 50 located behind the pivot 26 and extending between the first beam 30*a* and the second beam 30*b*. Support plate 50 may be mounted through holes 32 in the first support beam 30*a* and the second support beam 30*b* and may be attached using a brace 34 and bolts, or the like. As further shown in FIG. 2, drilling mast 18 may be mounted within mast coupling assembly 16 and may be supported at pivot 26. As described above, drilling mast 18 may move/rotate within mast coupling assembly 16 about pivot 26 in order to move from a stowed, horizontal position into a position for a desired drilling angle (e.g., any positive drilling angle position $\theta_1$ or any negative drilling angle position $\theta_2$). When drilling mast 18 is set to the desired drilling angle position, it may be locked into place using a locking mechanism, such as lock pin 36. Lock pin 36 may be attached at the bottom of drilling mast 18 and may be inserted into a respective lock aperture 76 of the mast coupling assembly 16 to lock the drilling mast 18 into place during a drilling operation.

Figure 3:
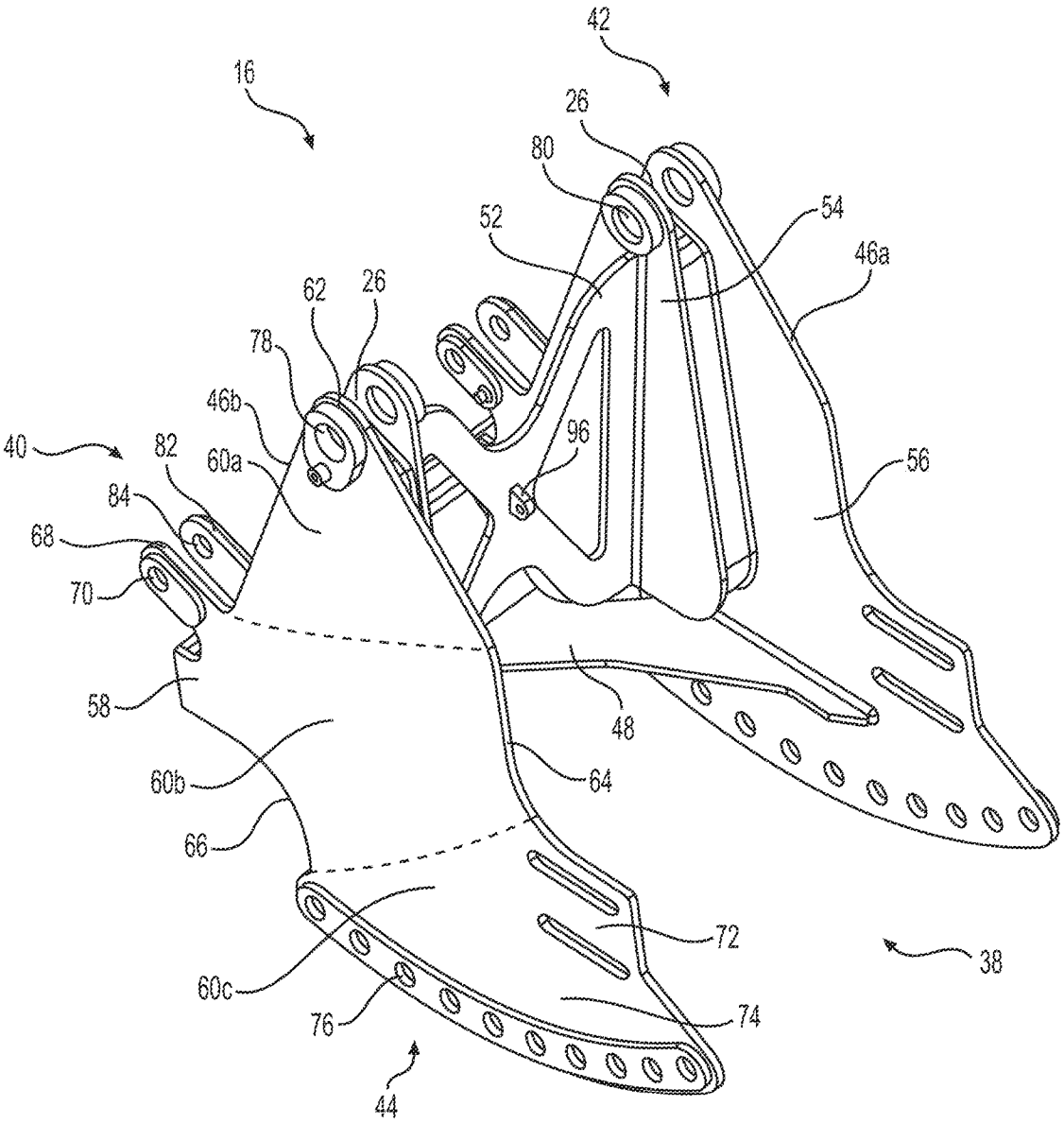
FIG. 3 illustrates an isolation view of the mast coupling assembly of FIGS. 1 and 2.

FIG. 3 illustrates an isolation view of the mast coupling assembly 16 of the mobile drilling machine 10. As shown in FIG. 3, mast coupling assembly 16 may include a front end 38, a rear end 40, a top end 42, and a bottom end 44. Mast coupling assembly 16 may comprise a first side plate 46*a*, a second side plate 46*b*, a bottom plate 48, and a reinforcing plate 52. Mast coupling assembly 16 may further include extension plates 54 to provide added support when drilling mast 18 is mounted within mast coupling assembly 16, as described further below. The first side plate 46*a* and the second side plate 46*b* may be coupled to the first beam 30*a* and the second beam 30*b* of the machine frame 12. The first side plate 46*a* and the second side plate 46*b* may be aligned and spaced apart from each other such that the first side plate 46*a* and the second side plate 46*b* are parallel to one another and each may include an inside surface 56 and an outside surface 58.

The first and second side plates 46*a*, 46*b* may comprise a shape that may allow for a desired strength-to-weight ratio to enable the mast coupling assembly 16 to support the weight of the drilling mast 18. As such, the first and second side plates 46*a*, 46*b* may include a top portion 60*a*, a middle portion 60*b*, and a bottom portion 60*c*. The top portion 60*a* of the first and second side plates 46*a*, 46*b* may comprise a substantially triangular shape. The substantially triangular shape of the top portion 60*a* may have a rounded apex 62. The additional vertices of the substantially triangular shaped top portion 60*a* may also be rounded and transition into the middle portion 60*b* of the first and second side plates 46*a*, 46*b*. At the front end 38 of the side plates 46, the middle portion 60*b* may include a concave front edge 64. At the rear end 40 of the side plates 46, the middle portion 60*b* may include a concave rear edge 66. The concave front edge 64 and the concave rear edge 66 of the middle portion 60*b* may transition into the bottom portion 60C of the first and second side plates 46*a*, 46*b*. The bottom portion 60*c* of the first and second side plates 46*a*, 46*b* may include a partially rectangular portion 72 and a rounded triangular portion 74 below the partially rectangular portion 72. At the rear end 40 of the side plates 46, the middle portion 60*b* may further include a protruding tab 68 that may extend rearward from the side plates 46. The tab 68 may include an attachment hole 70 for attaching the at least one primary fluid cylinder 28 to the mast coupling assembly 16. The attachment hole 70 may be reinforced to provide additional support when the at least one primary fluid cylinder 28 is coupled to the mast coupling assembly 16.

As further shown in FIG. 3, the first and second side plates 46*a*, 46*b* may each further include a plurality of lock apertures 76 that span along the bottom of the rounded triangular portion 74 of the bottom portion 60*c* of the first and second side plates 46*a*, 46*b*. While the exemplary embodiment shows the first and second side plates 46*a*, 46*b* each with ten lock apertures 76, the first and second side plates 46*a*, 46*b* may have any number of lock apertures 76, as necessary. First and second side plates 46*a*, 46*b* may further include a pivot hole 78 located adjacent the apex 62 of the substantially triangular top portion 60*a* of the first and second side plates 46*a*, 46*b*. Pivot hole 78 may also be reinforced in order to provide additional support when mast 18 is mounted.

Figure 4:
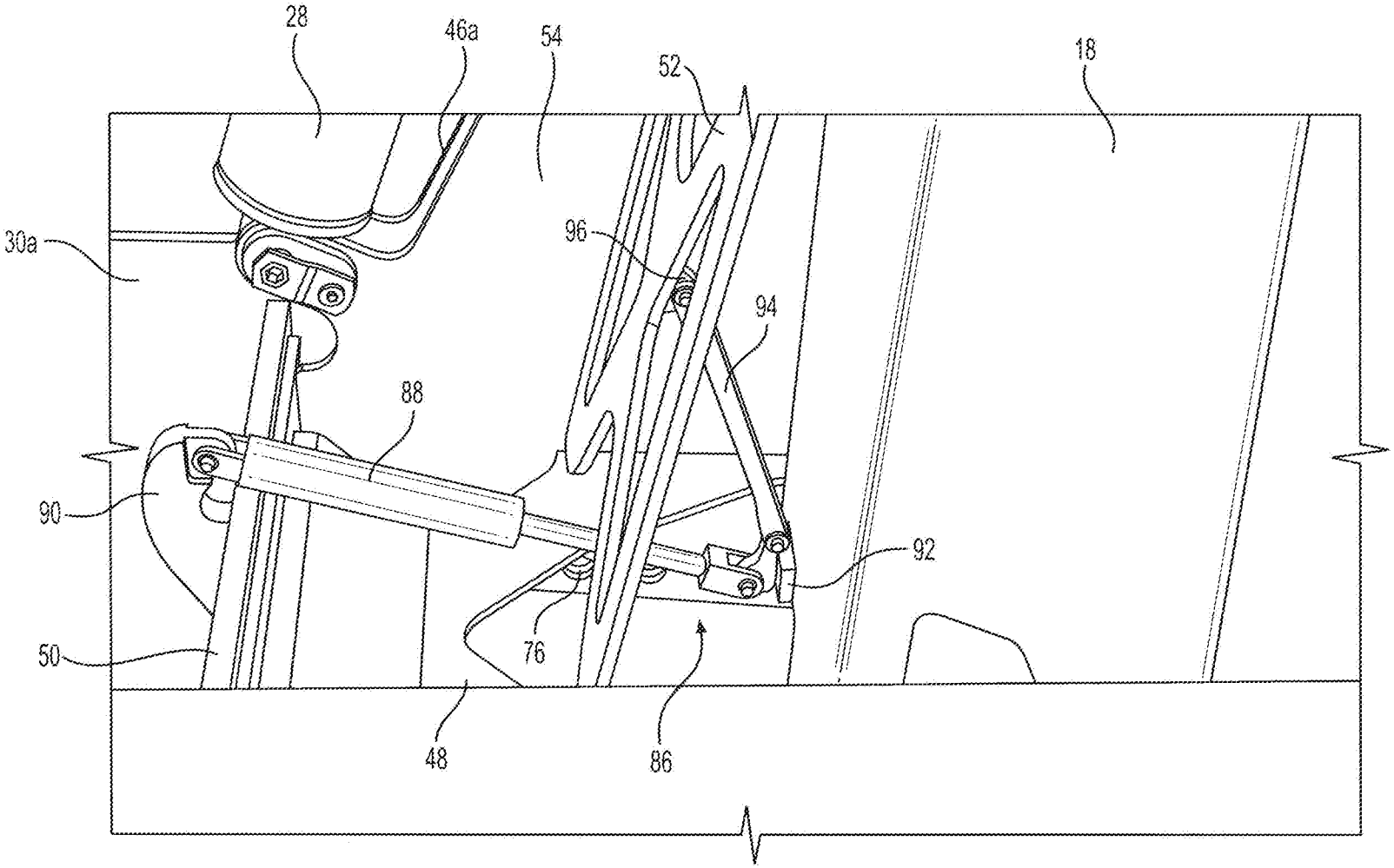
FIG. 4 illustrates an enlarged view of a portion of the mast coupling assembly of the mobile drilling machine of FIGS. 1-3.

Extension plates 54 may extend from the inside surface 56 of the first and second side plates 46*a*, 46*b* and may be aligned, or substantially aligned, with the substantially triangular top portion 60A of the first and second side plates 46*a*, 46*b*. Extension plates 54 may include a pivot hole 80 aligned, or substantially aligned, with pivot hole 78 of the first and second side plates 46*a*, 46*b*. Pivot hole 80 may be reinforced in order to provide additional support when drilling mast 18 is mounted within mast coupling assembly 16. Drilling mast 18 may be rotatably mounted within mast coupling assembly 16 at pivot 26 between pivot hole 78 and pivot hole 80. Further, lock apertures 76 may receive lock pin 36 to allow drilling mast 18 to be locked into place when set to a desired drilling angle position. Lock apertures 76 may be reinforced to provide additional support when the lock pin 36 is inserted into a respective lock aperture 76. Extension plates 54 may also include tabs 82 that extend from the rear portion of extension plates 54 and may be aligned with tabs 68 of the first and second side plates 46*a*, 46*b*. The tabs 82 may include attachment holes 84 for attachment of the at least one primary fluid cylinder 28 to the mast coupling assembly 16. For example, the at least one primary fluid cylinder 28 may include a first primary fluid cylinder 28 coupled to the first side plate 46*a*, as shown in FIG. 4. Likewise, the at least one primary fluid cylinder 28 may further include a second primary fluid cylinder (not shown) coupled to the second side plate 46*b*.

Bottom plate 48 of the mast coupling assembly 16 may be attached to and extend between the inside surface 56 of the first side plate 46*a* to the inside surface 56 of the second side plate 46*b*. Bottom plate 48 may be arranged above lock apertures 76 of the first and second side plates 46*a*, 46*b*, and below extension plates 54. Bottom plate 48 may be shaped such that it does not impede drilling mast 18 when drilling mast 18 is arranged in mast coupling assembly 16. For example, the shape of bottom plate 48 may allow for drilling mast 18 to pivot to any one of the lock apertures 76 without contacting bottom plate 48.

Reinforcing plate 52 may provide additional reinforcement between the first and second side plates 46*a*, 46*b*. Reinforcing plate 52 may extend between extension plates 54 and may be attached to extension plates 54 using any conventional attachment means, such as by welding and the like. In the exemplary embodiment, reinforcing plate 52 may have one or more holes or cutouts in order to reduce weight. However, reinforcing plate 52 may also be a solid plate. Reinforcing plate 52 may further provide a backstop for drilling mast 18, such that drilling mast 18 may not pivot past reinforcing plate 52. Reinforcing plate 52 may further include an attachment knob 96 that may allow attachment of a positioning member 94 (FIG. 4), as described below. Bottom plate 48 and reinforcing plate 52 may be attached to the first and second side plates 46*a*, 46*b* to form mast coupling assembly 16 using any conventional attachment means known in the art, such as by welding or the like.

FIG. 4 illustrates an enlarged view of a portion of the mast coupling assembly 16 with the second side plate 46*b* removed to illustrate inside the mast coupling assembly 16 when drilling mast 18 is set to a negative drilling angle position $\theta_2$ (FIG. 1). As shown in FIG. 4, coupling assembly 16 may further include an assist cylinder assembly 86 to support drilling mast 18 when drilling mast 18 is set to a negative drilling angle position $\theta_2$. Support assembly 86 may include a secondary fluid cylinder 88, an attachment mount 90, a contact member 92, and a positioning member 94. Attachment mount 90 may be attached to support plate 50 by any conventional attachment means known in the art, such as by welding or the like. Attachment mount 90 may be attached at a back side of support plate 50 and may be located at, or near, a midpoint on support plate 50 between first beam 30*a* and second beam 30*b* of the machine frame 12. Attachment mount 90 may include a hook shape and may extend above a top side of support plate 50. A top portion of attachment mount 90 may include a bore for connecting the secondary fluid cylinder 88 to the attachment mount 90, as described below.

The secondary fluid cylinder 88 may include a first end (e.g., a head end) coupled to the support plate 50 at attachment mount 90 via the bore in the top portion of attachment mount 90. The secondary fluid cylinder 88 may be any suitable actuator, such as a hydraulic or pneumatic cylinder or the like. Secondary fluid cylinder 88 may extend from support plate 50 through an opening in reinforcing plate 52. Secondary fluid cylinder 88 may include a second end (e.g. a rod end) pivotably coupled to the contact member 92. Contact member 92 may be configured to abut the mast frame when the drilling mast 18 is at a negative drilling angle position $\theta_2$. Contact member 92 may be any suitable contact member, such as a plate or the like, and contact member may be pivotably connected to both the secondary fluid cylinder 88 and the positioning member 94. Contact member 92 may include a rear flange with a first bore and a second bore for facilitating the pivotal connection of the secondary fluid cylinder 88 and the positioning member 94. The second end of the secondary fluid cylinder 88 may include a clevis for fastening around the rear flange and the clevis may have a third bore that may be aligned with the first bore of the rear flange. The first bore of the rear flange and the third bore may receive a pin for pivotably coupling the second end of the secondary fluid cylinder 88 to the contact member 92.

Positioning member 94 may be pivotably coupled to the reinforcing plate 52 at the attachment knob 96. Positioning member 94 may be of any suitable linkage shape, such as a rod-shaped, bar-shaped, beam-shaped, or the like. Positioning member 94 may include a clevis for fastening around the rear flange and the clevis may include a fourth bore that may be aligned with the second bore of the rear flange. The second bore of the rear flange and the fourth bore of the positioning member 94 may receive a pin for pivotably coupling the positioning member 94 to the contact member 92. The positioning member 94 may provide vertical support for maintaining the secondary fluid cylinder 88 in position to support drilling mast 18 when mast 18 is positioned at a negative angle. As described below, when the drilling mast 18 is in a negative drilling angle position $\theta_2$, the secondary fluid cylinder 88 may be configured to apply a force to the drilling mast 18 at a position below the pivot 26 to assist the at least one primary fluid cylinder 28. As such, the secondary fluid cylinder 88, through the contact member 92, may facilitate movement of the drilling mast 18 from the vertical position Y to a negative drilling angle position $\theta_2$ for a drilling operation. Further, when the drilling operation is complete, the secondary fluid cylinder 88 may be extended such that contact member 92 pushes against the drilling mast 18 to raise the drilling mast 18 into the vertical position Y, from the negative drilling angle position $\theta_2$. When the drilling mast 18 is in a positive drilling angle position $\theta_1$, the secondary fluid cylinder 88 may separate from contact with drilling mast 18. As such, the secondary fluid cylinder 88 may be configured to only contact or abut the drilling mast 18 when the drilling mast 18 is at a negative drilling angle position $\theta_2$.

INDUSTRIAL APPLICABILITY

The disclosed aspects of coupling assembly 16 may be used by any blast hole drill machine 10 to allow for a drill rig mast 18 to pivot to angles beyond a vertical position Y for negative angle drilling.

Referring to FIG. 1, during operation, an operator may raise the drilling mast 18 to a drilling angle position (e.g., $\theta_1$ or $\theta_2$) by activating, for example two primary fluid cylinders 28 using a control in the operator cab 24. The primary fluid cylinders 28 may apply a force to the drilling mast 18 above a pivot 26 such that the drilling mast 18 may be rotated about the pivot 26 within mast coupling assembly 16. As such, the primary fluid cylinders 28 may move the drilling mast 18 between a stowed position, at ninety degrees (90°) from a vertical position Y to a positive drilling angle position $\theta_1$. If the desired drilling angle position is beyond the vertical position Y, for a negative drilling angle position $\theta_2$, the secondary fluid cylinder 88 may engage the drilling mast 18 at a position below the pivot 26. As such, the secondary fluid cylinder 88 may assist the primary fluid cylinders 28 in supporting the drilling mast 18 when the drilling mast 18 is at a negative drilling angle position $\theta_2$. When the desired drilling angle position ($\theta_1$ or $\theta_2$) is reached, drilling mast 18 may be locked into place by extending lock pin 36 into a respective lock aperture 76 of the mast coupling assembly 16. Lock pin 36 may be extended and retracted by the operator using a control in the operator cab 24.

When the drilling operation is complete, the lock pin 36 may be retracted to unlock the drilling mast 18 and the secondary fluid cylinder may push the drilling mast 18 back into the vertical position Y. To push the drilling mast 18 back into the vertical position Y, the secondary fluid cylinder 88 may be extended such that contacting member 92 pushes against drilling mast 18 until drilling mast 18 reaches the vertical position Y. When the drilling mast 18 is back in the vertical position Y, the secondary fluid cylinder 88 may disengage the drilling mast 18, such that primary fluid cylinders 28 may no longer need assistance in supporting the drilling mast 18. The at least one primary fluid cylinder 28 may then be retracted to lower the drilling mast 18 to a positive drilling angle position $\theta_1$ or to the stowed position, as needed.

The exemplary mobile drilling machine 10 of the disclosure may provide for an arrangement that facilitates positioning of the drilling mast 18 at a negative drilling angle position $\theta_2$. The at least one primary fluid cylinder 28 attached to the drilling mast 18 above the pivot 26 may facilitate movement of the drilling mast 18 from the stowed position to the vertical position Y. Further, engaging the secondary fluid cylinder 88 with the drilling mast 18 at a position below the pivot 26 along the drilling mast 18 may allow for the secondary fluid cylinder 88 to support the weight of the drilling mast 18 when the drilling mast 18 is set to a negative drilling angle position $\theta_2$. Thus, mobile drilling machine 10 may enable drilling mast 18 to be set to a negative drilling angle position $\theta_2$ for a drilling operation. When the drilling operation is complete, the secondary fluid cylinder further allows drilling mast 18 to be pushed back into the vertical position Y to be lowered to the stowed position by the at least one primary fluid cylinder 28.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mobile drilling machine for negative angle drilling, comprising:

a drilling mast including a mast frame, a movable drill motor assembly, and a pivot;

a machine frame having a front portion and a back portion, the machine frame including:

an engine;

a ground engaging assembly;

a mast coupling assembly including:

a first side plate; and a second side plate, wherein the drilling mast is pivotably coupled at the pivot between the first side plate and the second side plate to allow for negative angle drilling;

at least one primary fluid cylinder coupled to the machine frame to apply a force to the drilling mast at a position above the pivot along the drilling mast to assist in moving the drilling mast between a stowed position to a drilling position; and a secondary fluid cylinder coupled to the machine frame to apply a force to the drilling mast at a position below the pivot along the drilling mast to assist the at least one primary fluid cylinder when the drilling mast is at a negative drilling angle, wherein the secondary fluid cylinder includes a first end coupled to a support plate located behind the pivot.

2. The mobile drilling machine of claim 1, wherein the secondary fluid cylinder includes a second end coupled to a contact member, the contact member configured to abut the mast frame when the drilling mast is at a negative drilling angle position.

3. The mobile drilling machine of claim 2, wherein the mast coupling assembly further includes a positioning member coupled to the machine frame and the secondary fluid cylinder to vertically position the second end of the secondary fluid cylinder.

4. The mobile drilling machine of claim 3, wherein the mast coupling assembly of the machine frame further includes a reinforcing plate connecting the first side plate and the second side plate, and the positioning member is pivotably coupled to the reinforcing plate.

5. The mobile drilling machine of claim 1, wherein the at least one primary fluid cylinder includes a first primary fluid cylinder and a second primary fluid cylinder, the first primary cylinder pivotably coupled to the first side plate, and the second primary cylinder pivotably coupled to the second side plate.

6. The mobile drilling machine of claim 1, wherein the first side plate and the second side plate each further include a plurality of lock apertures configured to receive a lock pin of the drilling mast for locking the drilling mast in the drilling position, and wherein the plurality of lock apertures are aligned such that the drilling mast is capable of being locked at drilling angles between the stowed position and a vertical position and at negative drilling angles beyond the vertical position.

7. The mobile drilling machine of claim 1, wherein the secondary fluid cylinder is positioned to be separated from the drilling mast when the drilling mast is at a positive angle position.

8. The mobile drilling machine of claim 1, wherein the machine frame further includes a first beam and a second beam, the first side plate of the mast coupling assembly being coupled to the first beam and the second side plate of the mast coupling assembly being coupled to the second beam.

9. The mobile drilling machine of claim 8, wherein the machine frame further includes a support plate located behind the pivot, the support plate coupled to and between the first beam and the second beam, and wherein the secondary fluid cylinder includes a first end coupled to the support plate.

10. A mobile drilling machine for negative angle drilling, comprising:

a drilling mast including a mast frame, a movable drill motor assembly, and a pivot;

a machine frame having a front portion and a back portion, the machine frame including:

an engine;

a ground engaging assembly;

a mast coupling assembly including:

a first side plate; and a second side plate, wherein the drilling mast is pivotably coupled at the pivot between the first side plate and the second side plate to allow for negative angle drilling;

a support plate located behind the pivot;

at least one primary fluid cylinder coupled to the machine frame to apply a force to the drilling mast at a position above the pivot along the drilling mast to assist in moving the drilling mast between a stowed position to a drilling position; and a secondary fluid cylinder coupled at a first end to the support plate and coupled at a second end to a positioning member to vertically position the second end of the secondary fluid cylinder, the secondary fluid cylinder being configured to apply a force to the drilling mast at a position below the pivot along the drilling mast to assist the at least one primary fluid cylinder only when the drilling mast is at a negative drilling angle.

11. The mobile drilling machine of claim 10, wherein the mast coupling assembly of the machine frame further includes a reinforcing plate connecting the first side plate and the second side plate, and the positioning member is pivotably coupled to the reinforcing plate.

12. The mobile drilling machine of claim 10, wherein the second end of the secondary fluid cylinder is further coupled to a contact member, the contact member configured to abut the mast frame when the drilling mast is at a negative drilling angle position.

13. The mobile drilling machine of claim 10, wherein the at least one primary fluid cylinder includes a first primary fluid cylinder and a second primary fluid cylinder, the first primary fluid cylinder pivotably coupled to the first side plate, and the second primary fluid cylinder coupled to the second side plate.

14. The mobile drilling machine of claim 10, wherein the first side plate and the second side plate each further include a plurality of lock apertures configured to receive a lock pin of the drilling mast for locking the drilling mast in the drilling position, and wherein the plurality of lock apertures are aligned such that the drilling mast is capable of being locked at drilling angles between the stowed position and a vertical position and at negative drilling angles beyond the vertical position.

15. The mobile drilling machine of claim 10, wherein the secondary fluid cylinder is positioned to be separated from the drilling mast when the drilling mast is at a positive angle position.

16. The mobile drilling machine of claim 10, wherein the machine frame further includes a first beam and a second beam, the support plate being coupled to and between the first beam and the second beam, and wherein the first side plate of the mast coupling assembly is coupled to the first beam and the second side plate of the mast coupling assembly is coupled to the second beam.

17. A method of operating a mobile drilling machine to move a drilling mast about a pivot for negative angle drilling, comprising:

activating at least one primary fluid cylinder coupled to the drilling mast above the pivot along the drilling mast to move the drilling mast about the pivot from a positive drilling angle position to a negative drilling angle position;

engaging a secondary fluid cylinder with the drilling mast below the pivot along the drilling mast to assist the at least one primary fluid cylinder when the drilling mast is in the negative drilling angle position, only when the drilling mast is in the negative drilling angle position;

locking the drilling mast in a drilling position by inserting a lock pin of the drilling mast into a respective lock aperture.

* * * * *